US005709596A

United States Patent [19]

Alexander et al.

[11] Patent Number: 5,709,596

[45] Date of Patent: Jan. 20, 1998

[54] ERGONOMICALLY PROFILED HAND GRIP FOR A HAND-HELD TOOL HAVING A PIVOTABLE POMMEL

[75] Inventors: David Charles Alexander; Robert Bruce Rummer, both of Auburn, Ala.

[73] Assignee: Ryobi North America, Easley, S.C.

[21] Appl. No.: 589,410

[22] Filed: Jan. 22, 1996

[51] Int. Cl.[6] ..... B24B 23/04

[52] U.S. Cl. ..... 451/357; 16/111 R; 16/121; 15/143.1; 15/DIG. 10

[58] Field of Search ..... 451/451, 454, 451/344, 354, 353, 357, 359, 524, 525; 16/110 R, 111 R, DIG. 12, 121; 15/DIG. 10, 143.1; D8/62

[56] References Cited

U.S. PATENT DOCUMENTS

| | | | |
|---|---|---|---|
| D. 286,736 | 11/1986 | Somers | D8/62 |
| D. 310,007 | 8/1990 | Saito et al. | D8/62 |
| D. 324,803 | 3/1992 | Butzen et al. | D8/62 |
| D. 326,398 | 5/1992 | Fushiya et al. | D8/62 |
| D. 332,734 | 1/1993 | Fushiya et al. | D8/62 |
| 2,443,001 | 6/1948 | Frendo | 15/143.1 |
| 2,513,271 | 7/1950 | Bluemink et al. | 16/121 |
| 2,592,093 | 4/1952 | Wentz | 451/524 |
| 4,145,848 | 3/1979 | Hutchins | 451/359 |

*Primary Examiner*—Robert A. Rose
*Attorney, Agent, or Firm*—Brooks & Kushman P.C.

[57] ABSTRACT

An ergonomically profiled hand grip for a hand-held tool. The hand grip has a contoured top surface and a pommel attached thereto. The centerline of the pommel is offset from the axis of the contoured top surface at an angle of approximately 45°. The pommel is contoured to comfortably fit between the thumb and index finger of the user while the fingers extend over the top surface. Preferably, the pommel is rotatably attached to the top surface making the hand grip equally accessible and comfortable to right and left hand users and for users with large or small hands.

20 Claims, 3 Drawing Sheets

ERGONOMICALLY PROFILED HAND GRIP FOR A HAND-HELD TOOL HAVING A PIVOTABLE POMMEL

TECHNICAL FIELD

The invention is related to hand grips for small tools and, in particular, to an ergonomically profiled hand grip for a palm orbital sander having a pivotable pommel to accommodate right and left handed users of the tool as well as a wide range of hand sizes.

BACKGROUND ART

Small tools, such as palm or hand sanders, normally have an upper surface contoured to mate with the user's hand, and in particular, to fit in the palm of the user's hand. These sanders may be held in at least two different modes. In the first mode referred to hereinafter as "Grip A", the palm of the user is placed over the top of the tool's hand grip with the user's wrist in a prone position and the fingers extended and the ends of the fingers locked over the edges of the hand grip. Alternatively, the user may grip the side of the tool with the palm of the hand and the wrist in a substantially vertical position, hereinafter called "Grip B". Grip B is uncomfortable for the user when sanding a horizontal surface because the forearm of the user in most applications is not parallel to the surface being sanded. Therefore, the wrist of the user has to be twisted or cocked to properly hold the sander parallel to the surface being worked on.

Although Grip A and Grip B type hand grips have found wide acceptance in small hand tools, these grips are not ergonomically or anthropometrically optimized from a user's point of view. Typically, these types of hand grips do not accommodate left and right handed users, fail to fit large and small hand sizes, and place the users hand and arm in awkward and potentially harmful work positions. The invention is an ergonomically profiled surface on a hand tool to optimize certain anthropometric measurements relative to the use of the tool and readily permit use by right or left handed people.

DISCLOSURE OF THE INVENTION

The object of the invention is an ergonomically profiled hand grip for a small hand-held tool to reduce the stress and fatigue of the user.

Another object of the present invention is to provide an ergonomically profiled hand grip having a pommel offset from the axis of the hand-held tool.

Another object of the invention is to provide a hand engagement surface on the tool from which the pommel is supported.

Still another object of the invention is to provide an ergonomically profiled hand grip for a random orbital sander and an orbital pad sander.

The ergonomically profiled hand grip has a contoured hand engagement surface provided on the hand tool which has a base and an axis normal to the base. A finger recess is provided about the periphery of the base intermediate the contoured surface and the hand tool and a pommel is provided on the contoured surface. The pommel has a centerline angularly offset from the axis normal to the base. The pommel is sized to be comfortably received between the thumb and index finger of the user and is contoured to rest on the soft tissue in the web between the thumb and index finger and on the soft tissue covering the proximal phalanges of the thumb and index fingers.

In the preferred embodiment, the pommel is pivotably mounted to the contoured surface to accommodate right and left handed users and various hand sizes.

These and other objects of the invention will become more apparent from a reading of the specification in conjunction with the drawings.

BEST MODE FOR CARRYING OUT THE INVENTION

Figure 1:
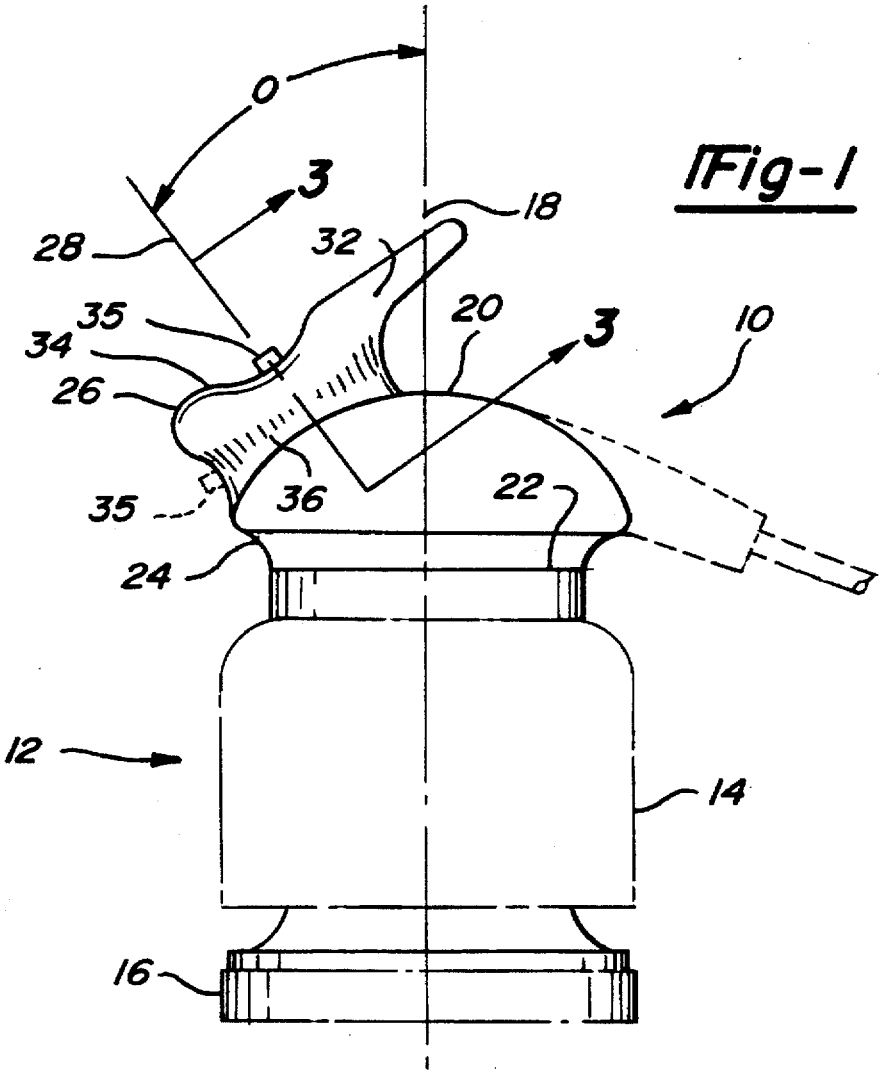
FIG. 1 is a side view of an ergonomically profiled hand grip according to the invention mounted on a palm held orbit sander.
Figure 2:
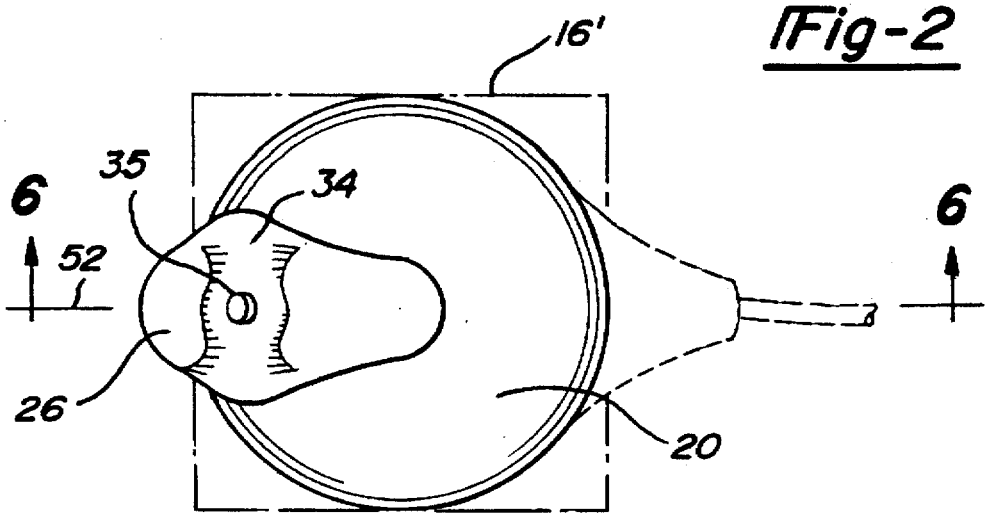
FIG. 2 is a top view of the hand grip shown in FIG. 1.

The ergonomically profiled hand grip for a hand tool is shown in FIG. 1. In the embodiment shown, the ergonomically profiled hand grip 10 is illustrated as mounted on a random orbital palm sander 12 of the type shown in U.S. Design Pat. No. 310,007, but is equally applicable to other types of small hand-held tools or devices. The illustrated random orbital palm sander 12 has a generally cylindrical housing 14 and an orbiting sanding pad 16 disposed normal to the axis of the housing 14. The orbiting sanding pad 16 may be circular as shown in FIG. 2 or square as shown in phantom by lines 16'.

The ergonomically profiled hand grip 10 has a hand engagement or top surface 20, which in the preferred embodiment has a generally round shape contoured to fit the palm of a user, but may have a teardrop configuration as illustrated in phantom to accommodate an electrical cord. The surface 20 may be a portion of a spherical surface, a portion of a parabloloid or other similarly shaped surface having an axis 18. The axis 18 is preferably coaxial with the axis of the housing 14 but may be offset therefrom to enhance a balancing of the weight of the orbital sander in the user's hand. The base 22 of the hand engagement surface 20 is preferably perpendicular to the axis 18 but may be disposed at preselected angle thereto for ergonomic reasons. In the preferred embodiment, the top surface has a diameter ranging from 3.8 to 4.3 inches.

The top surface 20 is preferably formed integral with the housing 14 but may be an independent component attached to the housing 14 at the end opposite the sanding pad 16. The top surface 20 may be constructed from a metal, rubber or a structural plastic material.

A finger tip indent 24 is provided about the circumference of the surface 20 to facilitate the gripping of ergonomically profiled hand grip about its periphery by the finger tips of the user.

A pommel 26 is attached to the surface 20 and has a centerline 28 angularly offset from the axis 18 by an angle θ. In the preferred embodiment, the centerline 28 of the pommel 26 is disposed at an angle approximately equal to 45° relative to the axis 18. However, the centerline 28 of the pommel 26 may be disposed at an angle ranging from 15° to 60° from the axis 18.

The pommel 26 has a generally hour-glass profile having an enlarged base 30 and an enlarged head 32. In the preferred embodiments, the under side of the pommel head 32 is contoured to rest on the soft tissue in the web between the thumb and the index finger and on the soft tissue covering the proximal phalanges of the thumb and index fingers. The enlarged head 32 may include a recess 34 for an on-off switch 35 as shown in FIGS. 1 and 2. Alternatively, the on-off switch 35 may be placed on the forward surface of the pommel as shown in phantom on FIG. 1. The lower surface 36 of the base 30 is contoured to mate with the top surface 20.

Figure 3:
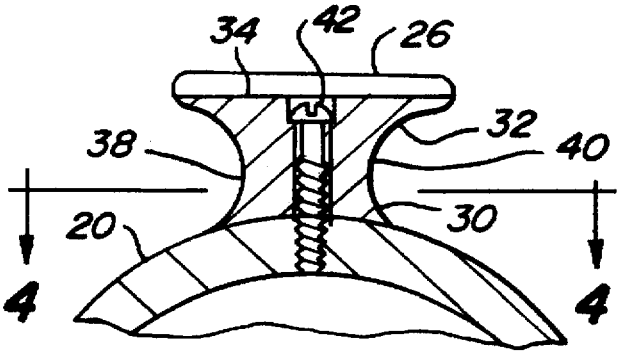
FIG. 3 is a cross-sectional view taken along section lines 3—3 of FIG. 1.
Figure 4:
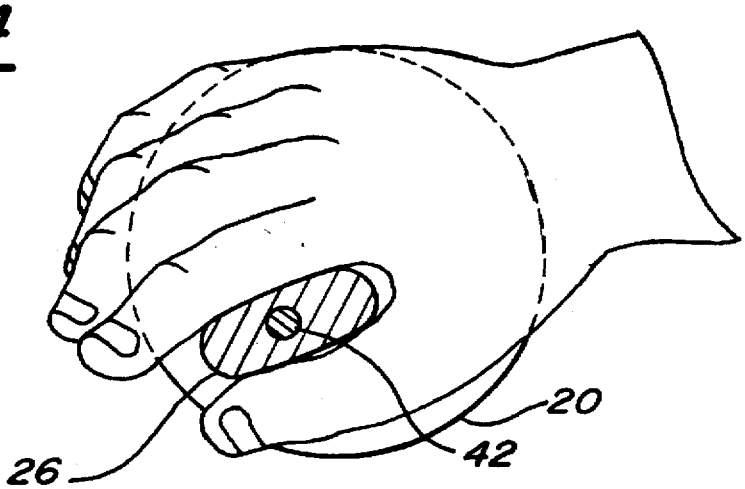
FIG. 4 is a cross-sectional top view showing the relationship of the user's hand to the pommel.

The right and left sides 38 and 40, respectively, of the pommel 26 are curved inwardly, as shown in FIG. 3, to reduce the thumb spread between the thumb and the index finger of the user to no larger than 2.7 inches and no less than 1.5 inches when using the palm sander 12. Thumb spread is defined as the distance from the phalangeal-metacarpal joint of the index finger to the interphalangeal joint of the thumb. This feature reduces the spread between the thumb and index finger ordinarily required by the hand grip of palm-held devices without a pommel and provides a firmer grip on the device for lifting or moving the hand-held device. As shown in FIG. 4, the pommel 26 has a substantially oval cross-section intermediate the surface 20 and the head 32 permitting the user to easily insert the pommel between the thumb and index finger. The pommel 26 may be fixedly attached to the surface 20 of the hand grip but preferably is rotatably attached to the surface 20 by means of a bolt 42 disposed through the pommel 26 substantially in line with and/or parallel to the centerline 28 or any other suitable means. For example, a shaft may be molded with the hand grip 10 extending outwardly from the surface 20 concentric to the center-line 28 and the pommel may have a bore received over the shaft.

Figure 5:
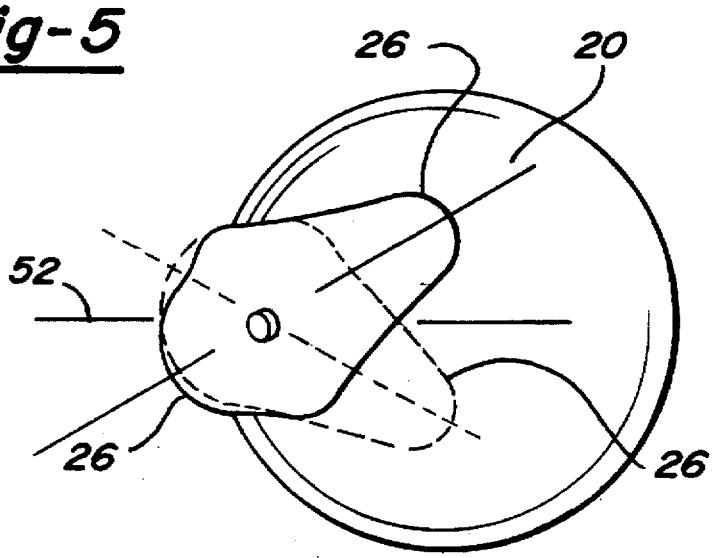
FIG. 5 is a top view showing the pivoting of the pommel on the surface of the hand grip.

The rotatable mounting of the pommel 26 to the surface 20 permits the pommel to be rotated relative to either side centerline 52 of the surface 20 as shown in FIG. 5. This permits the user to adjust the position the pommel 26 to his or her satisfaction. The rotating of the pommel 26 relative to the centerline 52 also permits the use of the ergonomically profiled hand grip by right or left handed persons with equal ease.

Figure 6:
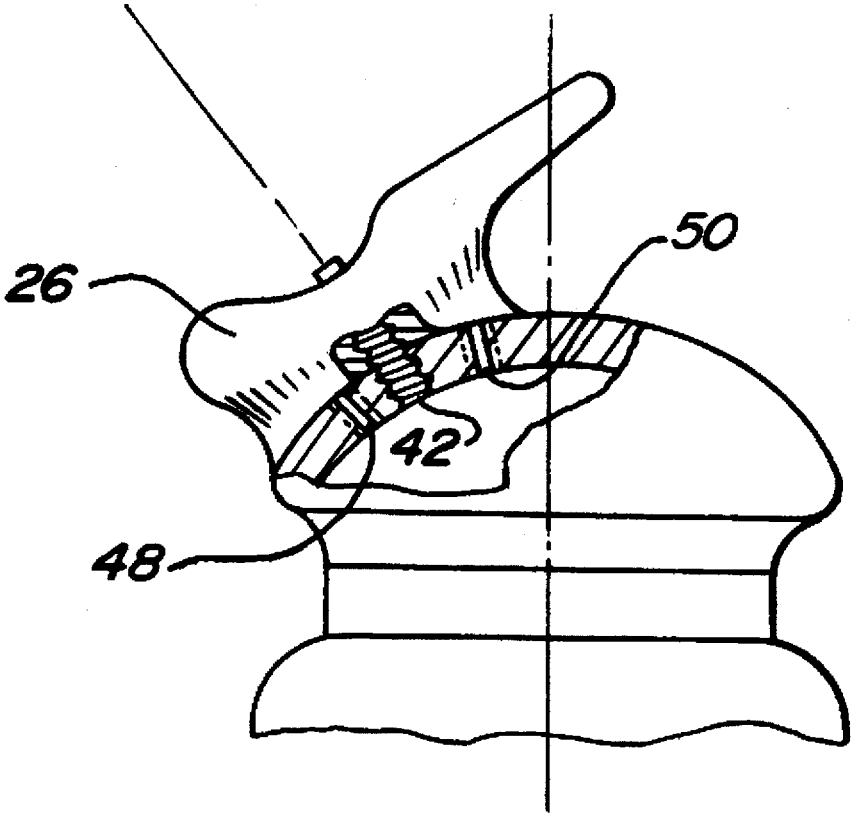
FIG. 6 is a partial side view showing the alternate locations to which the pommel may be attached.

The angular orientation of the centerline of the pommel 26 relative to the axis 18 may also be changed to accommodate various situations in which the angle of the users forearm may change. For example, the angle of the user's forearm relative to a work surface may be different for a short person than the angle of the forearm of a tall person. This may cause one or the other user to cock his wrist in an uncomfortable position when using the tool. To reduce this problem, the position of the pommel 26 relative to the axis 18 may be changed to a more comfortable position. To accommodate this changing of the position of the pommel 26 along the surface 20, a set of additional threaded bores, such as threaded bores 48 and 50 or some other means such as a sliding bolt may be provided along the centerline 52, as shown in FIG. 6, in which the bolt 42 is receivable.

The ergonomically profiled hand grip optimizes certain anthropometric parameters relative to the use of a tool such as a palm grip random orbit sander. The degree of pronation is in the range from 30° to 60°. In the preferred embodiment of the grip, the midline to fingertip distance which is a measure from the crease in the hand to the finger tip indent for the middle finger is in a range from 2.75 to 3.75 inches. The area of mechanical support which is the relative surface area of the hand supporting the tool weight in a vertical lift is enhanced by the combination of finger tip indent 24 and the enlarged head 32 of the pommel. Further, the ergonomically profiled handgrip has minimized pressure points.

The relative area of the palm below the crease in the palm which is in contact with the tool body, called palmar support area, is a relative measure dependent on the size of the person's hand and is substantially equal to palmar support area. The distance from the phalangeal-metacarpal joint of the index finger to the interphalangeal joint of the thumb about the pommel called thumb spread distance is no larger than 2.7 inches and no less than 1.5 inches. Finally, the hand width on the ergonomically profiled hand grip, which is the distance on the surface from the rear contour of the pommel to the lower edge of the hand contact area when the pommel is received between the thumb and the index finger, is approximately 4.0 inches.

Having described the best mode for carrying out the invention in detail, those familiar with the art to which this invention relates will recognize various alternative designs and embodiments for practicing the invention as defined by the following claims.

What is claimed is:

1. An ergonomically profiled hand grip for a hand-held device comprising:

a top surface provided at one end of the hand-held device contoured to mate with the palm of a user's hand, said top surface having a base, a periphery, and an axis normal to said base;

a fingertip recess provided about the periphery of the base intermediate said top surface and the hand-held device; and a pommel attached to said top surface, said pommel having a centerline angularly disposed relative to said axis of said base, said pommel sized to be received with comfort between the thumb and index finger of a user of the hand-held device, wherein said centerline is angular disposed relative to said axis at an angle between 15° and 60°.

2. The hand grip of claim 1 wherein said hand-held device has a housing, said top surface and fingertip recess are formed integral with the housing of the hand-held device.

3. The hand grip of claim 1 wherein said hand-held device has a housing, said top surface and said fingertip recess are a separate component attached to the housing of the hand-held device.

4. The hand grip of claim 1 wherein said pommel is made from a metal.

5. The hand grip of claim 1 wherein said pommel is made from rubber.

6. The hand grip of claim 1 wherein said pommel is made from plastic.

7. The hand grip of claim 1 wherein the hand-held device is a palm grip orbital sander.

8. The hand grip of claim 1 wherein said centerline is preferably disposed at approximately 45° relative to said axis.

9. The hand grip of claim 1 wherein said pommel has a top, a bottom, and sides, and wherein the sides of the pommel are tapered such that the cross-section at said top and said bottom are larger than a cross-section intermediate said top and bottom.

10. The hand grip of claim 9 wherein said pommel has an oval cross-section.

11. The hand grip of claim 10 wherein said oval cross-section of said pommel at a location intermediate said top and said bottom has a major diameter approximately 2.2 inches and a minor diameter approximately 1.4 inches.

12. The hand grip of claim 9 wherein said pommel further has a switch recess provided in said top of said pommel.

13. The hand grip of claim 1 wherein said pommel is rotatably attached to said top surface.

14. The hand grip of claim 9 wherein said pommel has an oval cross-section intermediate said top and said bottom.

15. The hand grip of claim 14 wherein said pommel has a top and a bottom and wherein said oval cross-section has a major diameter of approximately 2.2 inches and a minor diameter of approximately 1.4 inches.

16. The hand grip of claim 15 wherein the cross-section of said top and bottom of said pommel are larger than said cross-section intermediate said top and said bottom.

17. The hand grip of claim 15 wherein said pommel further has a switch recess provided at said top.

18. The hand grip of claim 7 wherein said pommel is pivotably attached to said top surface of said orbital sander.

19. The hand grip of claim 18 wherein said pommel has an oval ross-section.

20. The hand grip of claim 19 wherein said oval cross-section of said pommel has a major diameter of approximately 2.2 inches and a minor diameter of approximately 1.4 inches.

* * * * *

UNITED STATES PATENT AND TRADEMARK OFFICE

CERTIFICATE OF CORRECTION

PATENT NO : 5,709,596

DATED : January 20, 1998

INVENTOR(S) : David Charles Alexander et al.

It is certified that error appears in the above-identified patent and that said Letters Patent is hereby corrected as shown below:

Column 4, line 37, delete the word "angular" and insert the word --angularly-- in its place;

Column 6, line 6, delete the word "ross-section" and insert the word --cross-section-- in its place.

Signed and Sealed this

Eighth Day of December, 1998

Bruce Lehman

*Attest:*

BRUCE LEHMAN

*Attesting Officer*

*Commissioner of Patents and Trademarks*